US007174845B2

(12) United States Patent
Middleton

(10) Patent No.: US 7,174,845 B2
(45) Date of Patent: Feb. 13, 2007

(54) LOCKING WATER SKI AND BOATING EQUIPMENT STORAGE RACK

(76) Inventor: Paul Lawrence Middleton, 10707 32nd Ave. N., Plymouth, MN (US) 55441

( * ) Notice: Subject to any disclaimer, the term of this patent is extended or adjusted under 35 U.S.C. 154(b) by 94 days.

(21) Appl. No.: 10/950,757

(22) Filed: Sep. 28, 2004

(65) Prior Publication Data

US 2006/0070567 A1 Apr. 6, 2006

(51) Int. Cl.
*B63B 17/00* (2006.01)

(52) U.S. Cl. ..... 114/343

(58) Field of Classification Search ..... 114/343
See application file for complete search history.

(56) References Cited

U.S. PATENT DOCUMENTS 3,746,224 A * 7/1973 Folgner ..... 224/311
3,990,655 A 11/1976 Covell
4,057,984 A 11/1977 Avaiusini
4,231,586 A 11/1980 Krause
4,312,532 A 1/1982 Crump, Jr.
4,438,878 A 3/1984 Heslop
4,494,805 A 1/1985 Washburn
4,516,709 A * 5/1985 Bott ..... 224/315
4,598,561 A 7/1986 Girard
4,720,031 A 1/1988 Zimmerman
5,063,762 A 11/1991 Vandeweghe
5,390,840 A * 2/1995 Arvidsson ..... 224/324
6,174,106 B1 * 1/2001 Bishop et al. ..... 405/3
6,257,261 B1 * 7/2001 Johnson ..... 135/96

* cited by examiner

*Primary Examiner*—Jesús D. Sotelo

(57) ABSTRACT

An apparatus for securely mounting one or more water skis for storage is disclosed. The apparatus offers a simple method of securing the water ski with provision for locking to prevent theft. The apparatus is further suitable for mounting beneath a boat lift canopy, providing convenient access to the water skis and allowing water skis to dry after use. A variation on the apparatus allows for secure storage of other boating equipment.

1 Claim, 9 Drawing Sheets

LOCKING WATER SKI AND BOATING EQUIPMENT STORAGE RACK

BACKGROUND OF THE INVENTION

This invention relates to the sport of water skiing, and more specifically to storage systems for water ski equipment.

A variety of ski locking devices have been proposed in the past; most for use on snow skis. One set of these proposed devices are those that lock two skis together in such a way as to make them difficult to carry, for example, U.S. Pat. No. 4,598,561. Another set of proposed devices require a bracket to be placed on the ski for purposes of locking, for example, U.S. patents U.S. Pat. Nos. 4,057,984 and 4,231,586. When one has spent a large amount on the purchase of a water ski, it may not be desirable to make such drastic modifications. A third set of proposed devices are those which are carriers for a single pair of skis, with a locking attachment, generally a cable to lock it to some structure. Examples of these systems are U.S. patents U.S. Pat. Nos. 3,990,655 and 4,312,532. Further inventions make use of the ski pole as a key part of the system, such as U.S. Pat. No. 5,063,762. All of the above, though they accomplish the goal of locking skis, are quite different from the present invention in both method of locking, portability of locked skis, and quantity of skis that can be handled.

U.S. Pat. Nos. 4,438,878 and 4,720,031 are more similar to the present invention in that they describe systems to lock multiple pairs of skis. However, these are both systems specifically for carrying skis on top of automobiles. Their construction features and locking mechanisms are designed to accommodate snow skis and automotive mounting only, and as such they require side top access to operate.

U.S. Pat. No. 4,494,805 describes a system which locks skis to a fixed locker building. However, it describes individual locks for each pair of skis, rather than a single locking mechanism to lock multiple sets of skis.

Both U.S. Pat. Nos. 4,494,805 and 4,720,031 handle pairs of skis in a back-to-back fashion, which is unsuitable for water-ski use, as the fin protruding from the bottom of the water-ski interferes with handling the skis in this manner. Furthermore, water-skis are often not purchased or used in pairs, as slalom water-skiers prefer to ski with a single ski.

The ski locking mechanisms noted above are not readily adapted for water ski use, due to the different physical characteristics of the water ski from the snow ski, and due to differing patterns of usage.

A particular segment of the water skiing population uses a boat which is left on the water for the entire water ski season, with the boat typically stored on a boat lift with a canopy covering the lift and boat to protect the boat from the weather. For these water skiers, there are currently limited options for storage of water skis when not in use.

It is preferred to have the water skis stored near the boat, to avoid the labor of carrying them to the boat when they are needed. However, skis left on the floor of a boat obstruct movement around the boat, and so are often not desired in the boat when they are not going to be used. Further, a boat lift on a lake is generally very vulnerable to theft of loose items. Water skis are easily carried and can have a significant value, so they are potential theft targets, and it is preferred to keep them locked up.

Some skis may be stored within locking compartments within the boat. While this option provides the advantage of having the skis stored at their point of use, it is limited in that the skis are stored in a closed chamber, where there is a danger of the skis not properly drying after use. Further, boats have limited locking storage space, and many boats have no locking storage space, so many skiers have a need to store more skis than will fit within the locking storage space within the boat.

Another popular solution is to locate a locking storage building near the lake for storage of water sports equipment. While this offers welcome security, procurement of such a structure is a significant expense. Further steps must be taken to control humidity within such a building to prevent growth of mold and mildew on the water sports equipment. Additionally, the water skis must still be carried to the boat when they are needed.

The cost and humidity issues of the solution above lead many to store their water skis in their houses or garages, which provides a secure and dry environment for storage, but presents the greatest inconvenience for usage. A water skiing family might have two sizes of children's skis, a set of adult combo skis, and one or more slalom skis, which requires a fair amount of work to transport to the boat.

Storage lockers are commercially available. Some of these are constructed of a steel mesh which would allow objects within to dry. However, to acquire enough space to contain 7 or 8 skis would require a very large, and very heavy, locker. Finding room for this on the dock could be a problem. Further, it is not as convenient as having the skis available right inside of the boat lift.

The present invention, as described in the following sections, addresses some of the storage needs and issues identified above.

BRIEF SUMMARY OF THE INVENTION

Some of the shortcomings of the prior art are addressed in the present invention, which relates to an apparatus for locking storage of water skis which is suitable for installation beneath a boat lift canopy. A variation on this apparatus is suitable for locking storage of other boating equipment, such as life jackets and tow ropes.

FIG. 1 shows a side elevation view of a typical boat lift holding a boat in the storage position, slightly above the water surface. Such a boat lift is typically placed in 3–5 feet of water, and has a dock positioned alongside of the lift for easy access to the boat. FIG. 1 illustrates 1 ski in a storage position under the boat lift canopy. It is supported by two transverse members, one supporting the front of the ski in front of the bindings, and the other supporting the rear of the ski between the bindings and the fin. The ski is positioned upside down to allow water to drain out of the bindings. FIG. 2 shows the same boat lift in a plan view, illustrating how multiple skis may be stored. Skis stored in this manner are easily reached from within the boat, are stored out of the weather, and are not easily visible from shore due to the shelter of the boat lift canopy. FIGS. 1 and 2 do not show mounting details for simplicity.

The locking feature of the present invention is accomplished through means of a third transverse member, called a locking bar, as shown in FIG. 5. This new member is positioned above the skis, directly above and parallel to the rear support member. These two members together form a clamp, securely holding the back end of the skis. A center locking mechanism, which is accessible from beneath, keeps the two members together. Alignment tabs at each end of the locking bar prevent the skis from removal by sliding sideways, and prevent rotation of the members. The skis can not be removed by sliding forward or backwards due to interference with either the binding or the fin.

The present invention allows water skis to be stored inside of the boat lift, removing the problem of carrying skis to and from the boat. The skis are in open air, where they will properly dry, preventing mildew problems. Further, the skis can be securely locked to guard against theft. This locking is accomplished with a very simple mechanism which does not require any modification to the skis, and which can accommodate virtually any ski on the market.

A single transverse member may be modified to utilize a locking mechanism at one end. In this form, the present invention may be used to store other boating equipment, as illustrated in FIG. 10. Life jackets, tow ropes, or tubes may be accommodated in this manner, as well as any other equipment which can be hung and secured by means of passing the transverse member through a hole in the equipment. When this device is mounted under the canopy of a boat lift, the equipment is secure, free of mildew, and conveniently available when needed.

These advantages and others are more fully described in the following detailed description of the invention.

DETAILED DESCRIPTION OF THE INVENTION

A key goal of this invention is to provide locking storage within a boat lift, to allow for both ease of accessibility and an open-air atmosphere conducive to allowing skis and equipment to dry after use. For this reason, the first portion of the description concerns the location of the device relative to the boat and boat lift.

Figure 1:
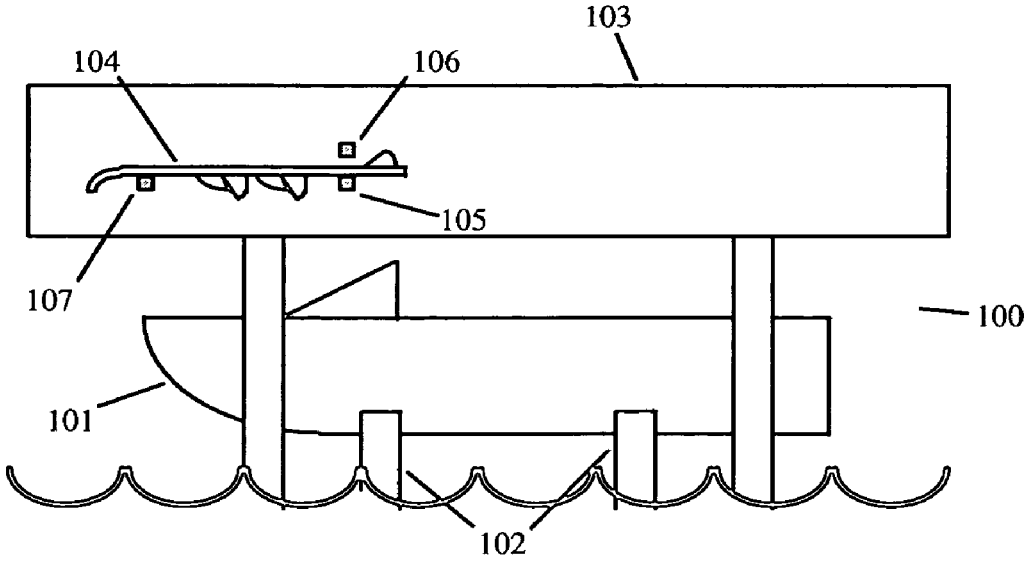
FIG. 1 is a side elevation view of a typical boat lift with a boat in the storage position, showing the preferred mounting location of the present invention.

FIG. 1 illustrates boat 101 with window resting on the boat supports 102 of boat lift 100. Atop the boat lift, canopy 103 is drawn as transparent with respect to the present invention, although canopy supporting hardware is not shown, in order to clearly establish the positioning of this invention within the boat lift. Accordingly water ski 104 is shown resting on transverse members 105 and 107 beneath locking bar 106 positioned under the canopy 103 and above the boat 101. This allows for both easy access to the water ski from within the boat, while generally preventing valuable water skis from being visible from outside of the boat lift, reducing the risk of any attempt at theft.

Figure 2:
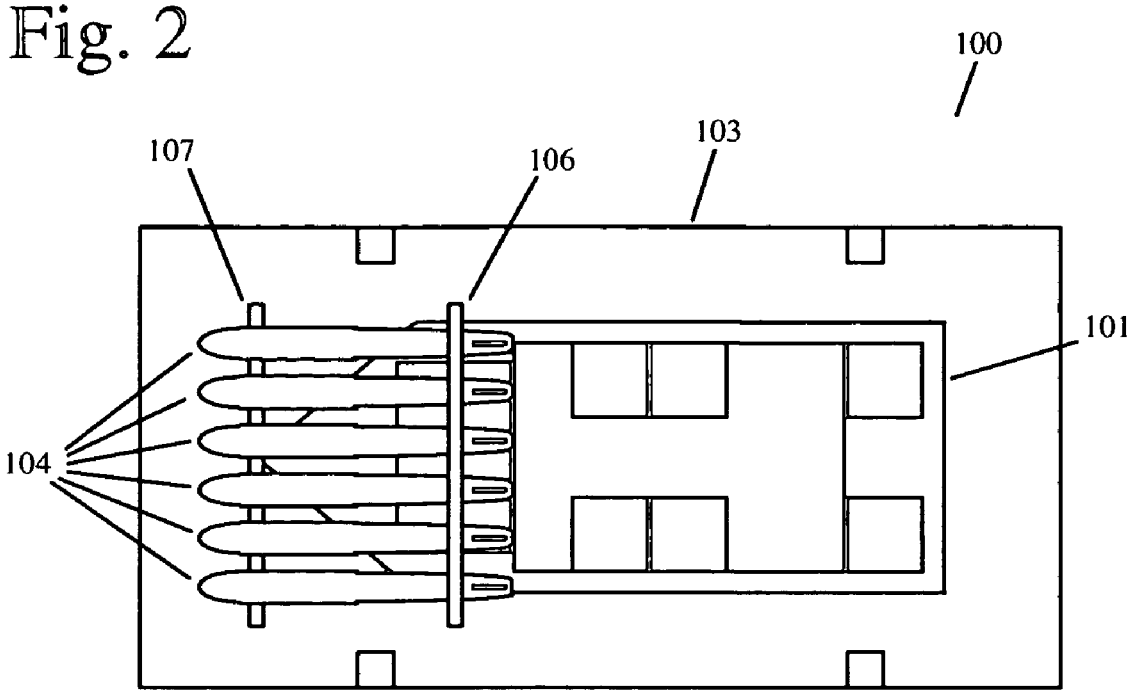
FIG. 2 is a top plan view of a typical boat lift, showing the preferred mounting location of the present invention.
Figure 3:
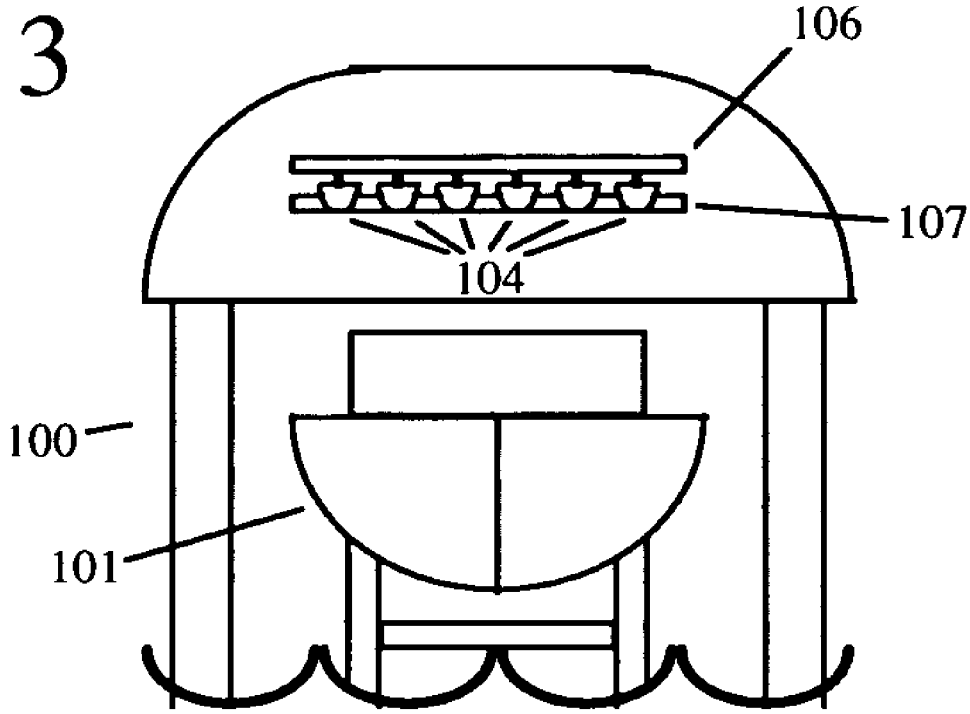
FIG. 3 is a front elevation view of a typical boat lift, showing the preferred mounting location of the present invention.

To further establish the positioning of the ski storage rack, FIG. 2 illustrates the top plan view of boat lift 100. Canopy 103 is again shown as transparent, while canopy supporting hardware is not shown for clarity. Front transverse member 107 and locking bar 106 of ski rack are shown to extend across the width of boat 101, allowing for locking storage of several water skis 104 simultaneously. FIG. 3 completes the description of the orientation of the ski rack with a front elevation view of the same boat lift 100. Canopy 103, again shown as transparent and without supporting hardware, contains beneath it front transverse member 107, locking bar 106, and water skis 104.

Now that the ski rack position has been established, a more detailed description of the hardware features follows.

Figure 4:
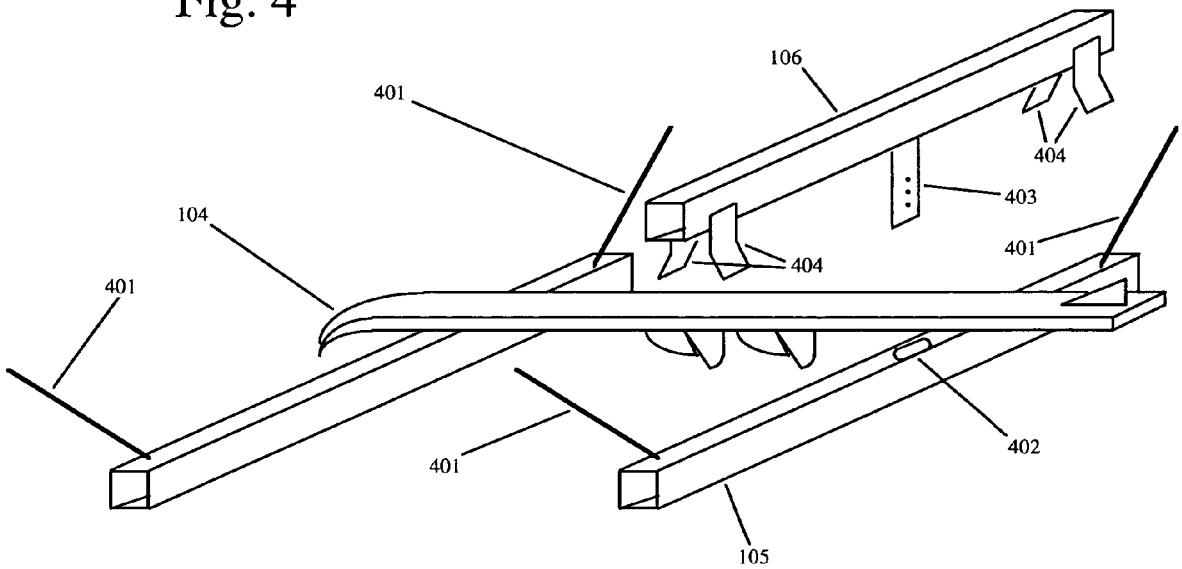
FIG. 4 is an isometric perspective drawing showing the top and bottom transverse members in the open or unlocked position.

FIG. 4 is an isometric perspective drawing of the locking ski rack, without mounting detail, shown in the unlocked position. Water ski 104 rests upon front transverse member 107 and rear transverse member 105, both suspended by support cables 401. Locking bar 106 is shown manually raised above rear transverse member 105. This view shows hole 402 in center of rear transverse member 105 to accommodate locking pin 403 protruding from the bottom of locking bar 106. On either end of locking bar 106, alignment tabs 404 provide natural alignment to the transverse member 105. Note that in the unlocked position, as illustrated in FIG. 4, the skis are still fully supported, as locking bar 106 is not required to support the skis.

Figure 5:
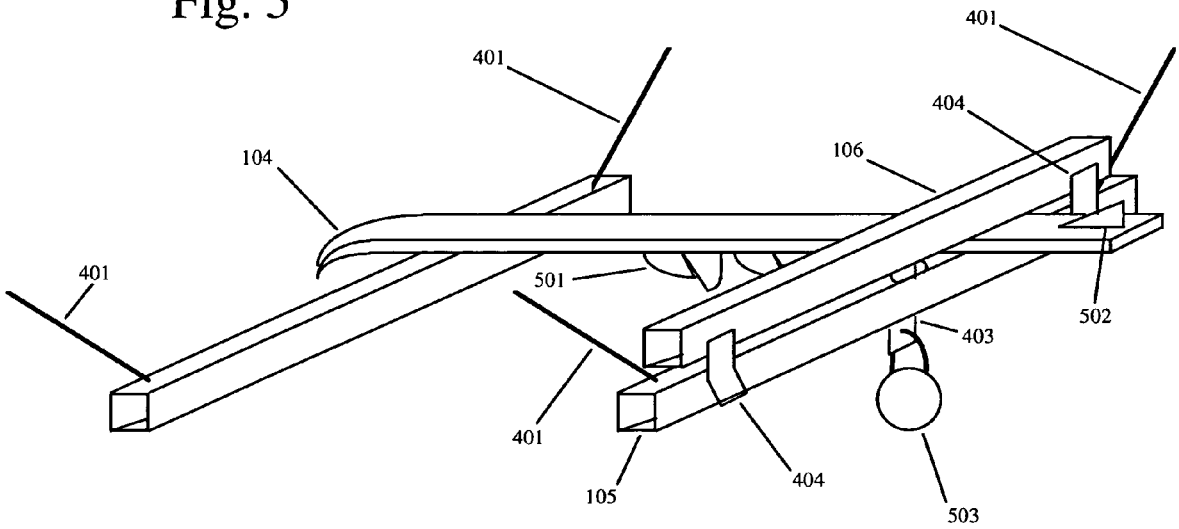
FIG. 5 is an isometric perspective drawing showing the top and bottom transverse members in the locked position.

FIG. 5 is an isometric perspective drawing of the locking ski rack, without mounting details, this time shown in the locked position. Locking bar 106 is now directly above rear transverse member 105 and clamping water ski 104 between water ski boot 501 and water ski fin 502. Lock 503 is attached through hole in locking pin 403 to prevent locking bar 106 from being released. In this position, note that water ski 104 can not be removed. Moving water ski 104 forward will result in interference between water ski fin 502 and locking bar 106. Moving water ski 104 backwards will result in interference between water ski boot 501 and rear transverse member 105. Moving water ski 104 to the side will result in interference between water ski 104 and alignment tabs 404. Removal of the water ski 104 is accomplished by unlocking lock 503 and removing it from locking pin 403. Locking bar 106 is then lifted above rear transverse member 105 and removed. At this time skis can be loaded or unloaded from ski rack.

To this point in the description, mounting details of the ski rack within the boat lift have not been described. There are many possible methods of mounting this ski rack within a boat lift which are well known to those skilled in the art. This section will describe the preferred embodiment, though many variations are anticipated by this invention.

Note that both lock 503 and locking pin 403 are accessible from beneath the ski rack. This is an important feature due to the mounting orientation of the ski rack relative to the users, in that the ski rack is typically mounted overhead. It is essential that the user have a clear view of lock 503 and locking pin 403 for ease of actuating and releasing the locking mechanism. As this device is intended for convenience, features which provide convenience to the user are of tantamount importance.

Similarly note that a single lock 503 is capable of locking and unlocking the entire ski rack, this is another feature of convenience for the user, and as such is of extreme importance.

Figure 6:
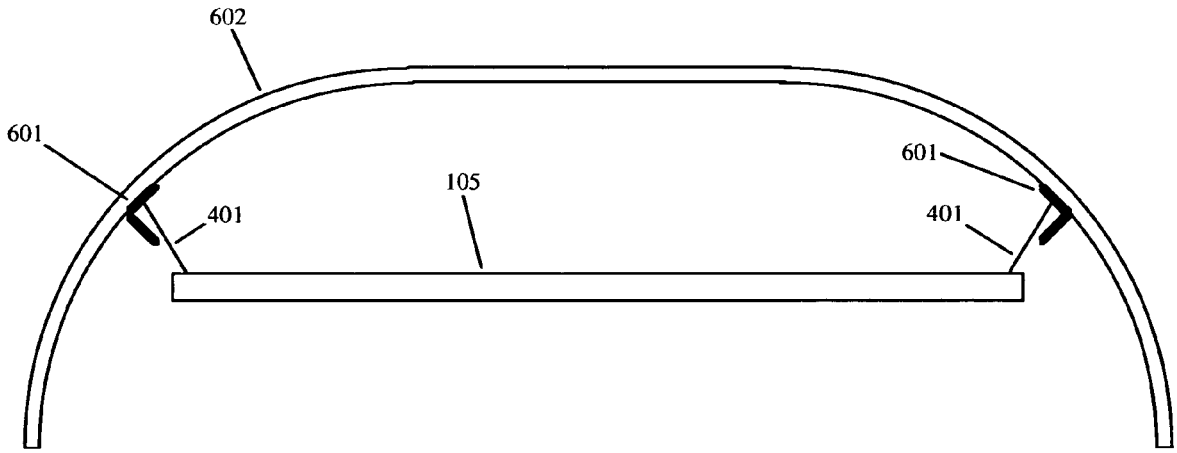
FIG. 6 is a rear elevation cross section of a boat lift canopy, illustrating the mounting of the tranverse members of the ski rack beneath the lift canopy.

Boat lift canopies are generally made of a canvas-like material, and are supported by a framework of ribs. A front elevation view of this rib framework is shown in FIG. 6 along with transverse member 105. Stiffening spars 601 are constructed of aluminum angles having pre-drilled holes along the full length of both flanges. These are attached perpendicular to canopy ribs 602 at appropriate positions to suspend transverse member 105 from support cables 401.

Figure 7:
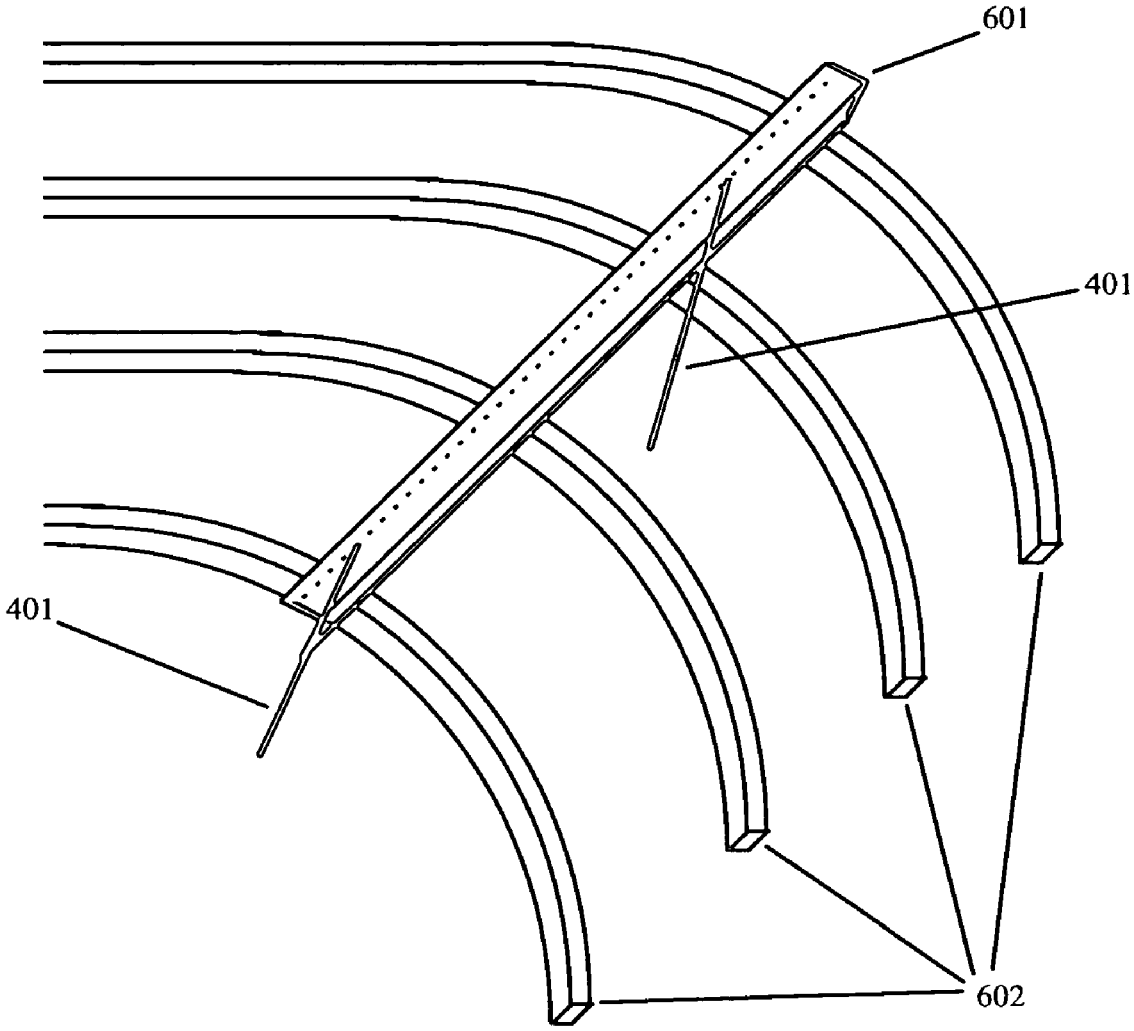
FIG. 7 is an isometric perspective drawing showing the view looking UP at the stiffening spar attached to the boat lift canopy ribs.

FIG. 7 further illustrates the position of stiffening spar 601 relative to canopy ribs 602 in an isometric perspective view of the inside of the boat canopy. Note that to properly view this drawing, one must interpret it as looking up at the canopy, so that stiffening spar 601 appears to be inside of the arc formed by canopy ribs 602.

Figure 8:
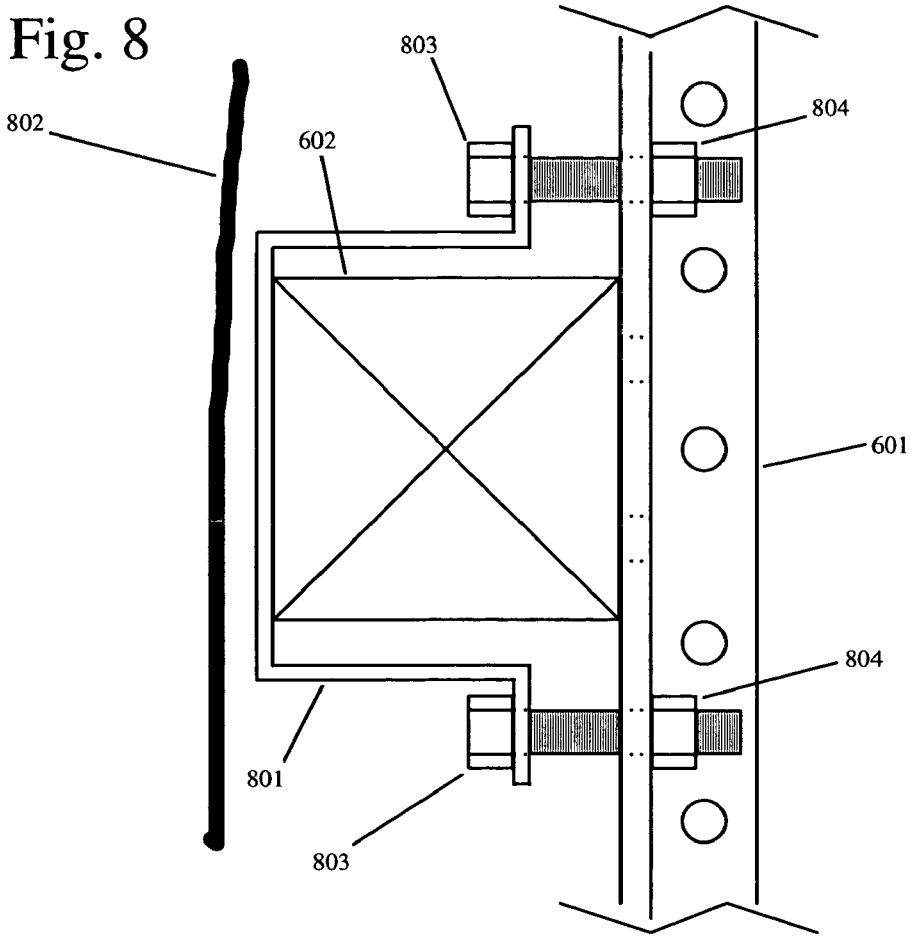
FIG. 8 is a detail on the connection of the stiffening spars to the boat lift canopy ribs.
Figure 9:
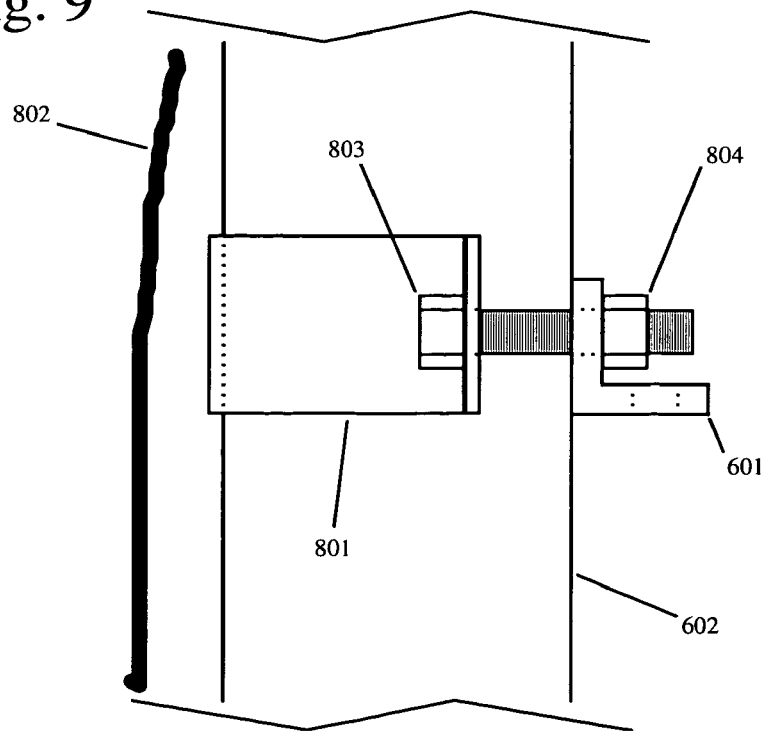
FIG. 9 is a detail on the connection of the stiffening spars to the boat lift canopy ribs.

Referring now to FIG. 8, a top plan view cross section of a canopy rib 602 with the mounting hardware for stiffening spar 601, and FIG. 9, a front elevation of the boat lift showing a cross section of stiffening spar 601 with the mounting hardware. Mounting clip 801 is fastened around canopy rib 602 inside of canopy fabric 802. Bolts 803 and nuts 804 secure mounting clip 801 to stiffening spar 601. The series of holes in stiffening spar 601 allow for its use with a variety of rib spacings on various boat lift canopies. The size of mounting clip 801 allows a similar flexibility for use with a variety of sizes of canopy rib 602.

The preceding text is a detailed description of the locking water ski storage rack. A variation on this invention may be used as a locking equipment rack. This equipment rack may be similarly placed within a boat lift canopy to achieve the same benefits of convenient access, air drying, and theft prevention. It has the limitation of locking only equipment which has a sizeable and permanent hole, as described in the following paragraphs.

Figure 10:
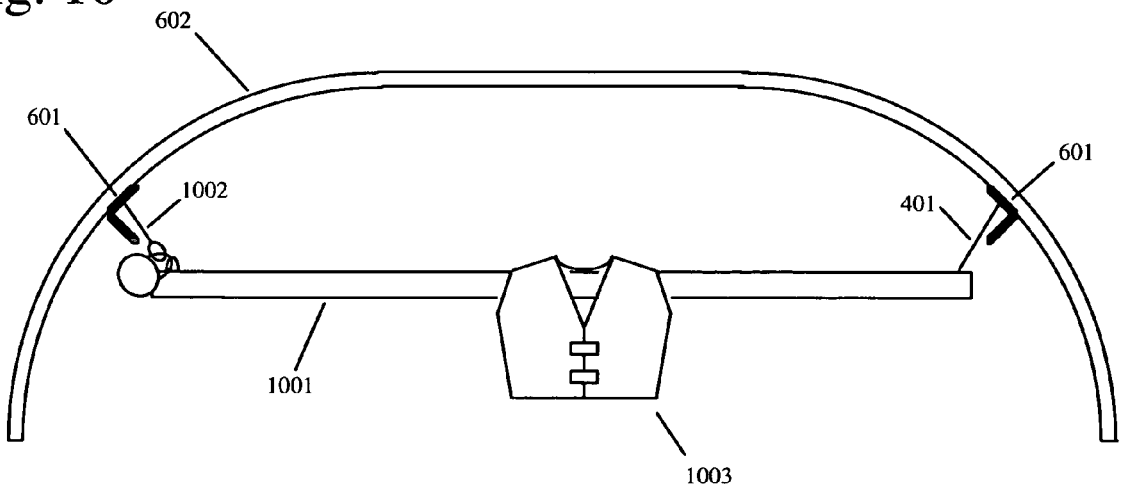
FIG. 10 is a rear elevation cross section of the boat lift canopy, illustrating the use of a transverse member as an equipment rack.

A single transverse member of the water ski storage rack may be modified slightly to allow locking storage of certain types of boating equipment. FIG. 10 illustrates this locking equipment rack in a front elevation view of the boat lift canopy. Transverse member 1001 is equipped with a locking connection to support cable 1002 at one end. Transverse member 1001 is threaded through the arm holes of life jacket 1003. This leaves life jacket 1003 securely fastened to transverse member 1001. The same method can be used to secure other items of boating equipment with a sizeable and permanent hole, including ski ropes (using the triangular hole near the handle) and some towable water sports devices ("tubes" can be threaded through center hole).

Figure 11:
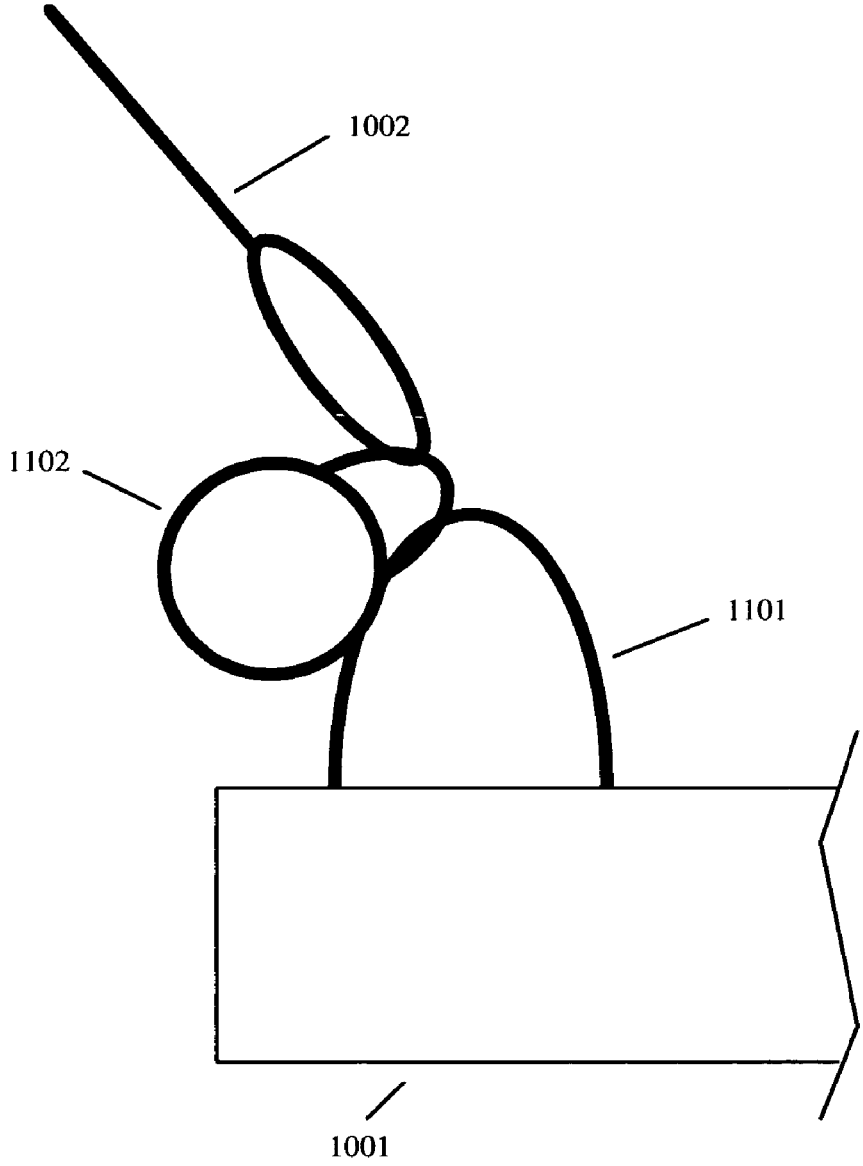
FIG. 11 is a detail of the locking mechanism connecting one end of the transverse member to the supporting cable, when used as an equipment rack.

FIG. 11 is a detail of the locking connection at one end of transverse member 1001. Eyelet 1101 is welded to transverse member 1001. Lock 1102 is fastened through loop at end of support cable 1002 and through eyelet 1101. Note that smooth surfaces are provided on all points both for ease of loading and unloading and so as to avoid damage to items with fragile coverings.

The lock 1102 may be removed for loading and unloading equipment. Once loading is completed, fastening lock 1102 both raises the equipment up under the canopy, and secures it against theft. Once latched thus, note that this rack provides ample space around the rack to accommodate bulkier equipment than that shown in the illustration. For example, a large innertube, often used in water sports as a device to be towed with a rider behind the boat, could be placed on this rack in its inflated state.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. Apparatus for securing water skis to another object comprising:

mounting means which suspends apparatus beneath said object to which it is attached, clamping means positioned anywhere between water ski bindings and water ski fin which constrains ski from movement up or down relative to clamping means, said clamping means being closely spaced enough to further constrain ski from movement forward or backwards relative to clamping means due to interference with either fin or bindings, said clamping means closed on sides to prevent water ski from removal by sliding to the side, moveable portions of said clamping means operating such that skis are supported and remain on apparatus when said locking or latching means is unlocked or unlatched, latching or locking means which constrains said clamping means in the clamped position and is accessible from beneath apparatus, said latching or locking means being comprised of a pin or tab which extends through or alongside of lower clamping member, and is secured beneath the lower clamping member.

* * * * *